US006179138B1

(12) United States Patent
Puleston

(10) Patent No.: US 6,179,138 B1
(45) Date of Patent: Jan. 30, 2001

(54) BOTTLE STOPPER AND OPENER

(75) Inventor: Cyan Puleston, W. New York, NJ (US)

(73) Assignee: General Housewares Corp., Terre Haute, IN (US)

( * ) Notice: Under 35 U.S.C. 154(b), the term of this patent shall be extended for 0 days.

(21) Appl. No.: 09/226,797

(22) Filed: Jan. 7, 1999

(51) Int. Cl.[7] ..... B65D 55/02

(52) U.S. Cl. ..... 215/226; 215/228; 215/303; 215/304; 81/3.15; 81/3.42; 81/3.55

(58) Field of Search ..... 215/226, 228, 215/295, 296, 303, 304; 81/3.09, 3.15, 3.42, 3.55

(56) References Cited

U.S. PATENT DOCUMENTS

| | | | | |
|---|---|---|---|---|
| D. 316,362 | | 4/1991 | Hughes et al. . | |
| D. 339,274 | | 9/1993 | Alpers . | |
| D. 358,311 | | 5/1995 | Sarnoff et al. . | |
| 514,200 | * | 2/1894 | Painter | 215/226 X |
| 757,548 | * | 4/1904 | Goodrich | 215/226 |
| 952,085 | * | 3/1910 | Stephens | 215/226 |
| 1,653,490 | * | 12/1927 | Ballou et al. | 215/226 |
| 3,300,074 | * | 1/1967 | Heubl | 215/226 |
| 4,580,303 | * | 4/1986 | Henshaw | 215/226 X |
| 4,846,360 | * | 7/1989 | Criste | 215/226 |

* cited by examiner

*Primary Examiner*—Stephen K. Cronin
(74) *Attorney, Agent, or Firm*—Seyfarth Shaw

(57) ABSTRACT

A combination utensil has a one-piece plastic body with a bottle-cap-removing ring and an elongated bottle stopper projecting substantially radially outwardly from the ring. The ring has inclined end faces tapering toward the stopper and an opening positioned eccentrically thereof and extending therethrough between the end faces and defined by a frusticonical wall, the opening being chamfered at the small-diameter end. A metal plate is insert-molded in the stopper and has a lip which projects radially into the ring opening at the small-diameter end thereof. The inner and outer surfaces of the ring, except for the chamfer, are covered with a frictional cushioning material which defines circumferentially spaced ribs projecting radially inwardly of the frusto-conical wall. The stopper is tapered toward a small-diameter distal end and its mid portion is surrounded with a frictional cushioning sheath having radially outwardly projecting circumferential ribs spaced axially of the stopper.

20 Claims, 3 Drawing Sheets

BOTTLE STOPPER AND OPENER

BACKGROUND OF THE INVENTION

The present invention relates to combination utensils of the type usable on containers, such as bottles. The invention has particular application to utensils of the type used for stopping and for removing the caps of bottles.

Various types of bottles stoppers and bottle cap removers have heretofore been provided. Bottle openers have included openers for use with a variety of different types of bottle closures. Thus, cork screws are provided for removing corks from the necks of bottles, such as wine bottles. Lever-type tools are utilized for prying off bottle caps of the type used on many beer and soda bottles, wherein the cap has a depending flange with a fluted edge crimped over a bead at the end of the bottle neck, such caps being referred to hereinafter as "pop-top" caps. The cap-removing utensil typically has an aperture which receives a portion of the cap therethrough, with a lip or flange at one side of the aperture which engages beneath the bottle cap flange to pry it off. Wrench-type tools are provided for unscrewing twist-off bottle caps, which are similar to pop-top caps, except that they are internally threaded for engagement with an external thread on the bottle neck. The opening utensil typically has an internally ribbed, cup-shaped member which fits over the cap to frictionally engage it to provide a wrench-type increase in leverage for twisting the bottle cap off. Many cans, such as beverage cans, are provided with a ring-type of pull tab, and prying-type tools have been provided to facilitate lifting of the pull tab.

It is also known to combine features of certain types of opening and/or bottle stopping devices. For example, twist-off cap removers have been combined with pull tab lifting levers, such as in U.S. Pat. Nos. 4,455,894 to Roberts and 4,911,038 to Ferrin, while pop-top cap removers have been combined with bottle stoppers in devices such as those disclosed in U.S. Pat. Nos. 760,797 to Biersach and 959,220 to Hoeft. However, such combination utensils heretofore have typically been formed of metal or have had other types of hard exposed surfaces and have been uncomfortable to use, particularly for people whose hands may be impaired, such as by arthritis. Furthermore, heretofore there have not been provided any combination utensils which are usable for removing both pop-top and twist-off caps.

SUMMARY OF THE INVENTION

It is a general object of the invention to provide an improved combination utensil which avoids the disadvantages of prior utensils while forwarding additional structural and operating advantages.

An important feature of the invention is the provision of a bottle cap remover which is usable with both pop-top and twist-off caps.

Another feature of the invention is the provision of a combination utensil which provides both a bottle cap remover and a bottle neck stopper.

Another feature of the invention is the provision of a combination utensil of the type set forth, which is of simple and economical construction.

Yet another feature of the invention is the provision of a combination utensil of the type set forth, which is comfortable and easy to use.

Certain ones of these and other features of said invention may be attained by providing a combination bottle cap-removing and bottle neck-closing utensil comprising a bottle-cap-engaging ring dimensioned to fit in a user's hand and having an opening therethrough dimensioned to receive at least a portion of a bottle cap therein, and a stopper extending laterally outwardly from the ring and dimensioned to fit in a user's hand and to be received in a bottle neck for closing same, whereby the ring and the stopper serve as handles for each other.

Other features of the invention may be obtained by providing a bottle cap remover comprising a ring-like body having an internal generally frustoconical wall defining an opening through the body and having large-diameter and small-diameter ends, and a rigid lip carried by the body and projecting into the opening adjacent to the small-diameter end.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 7:
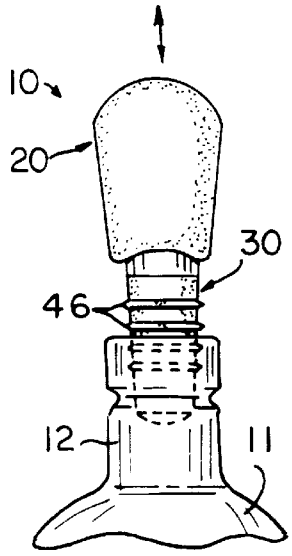
FIG. 7 is a reduced side elevational view illustrating use of the utensil of the present invention as a bottle stopper.
Figure 8:
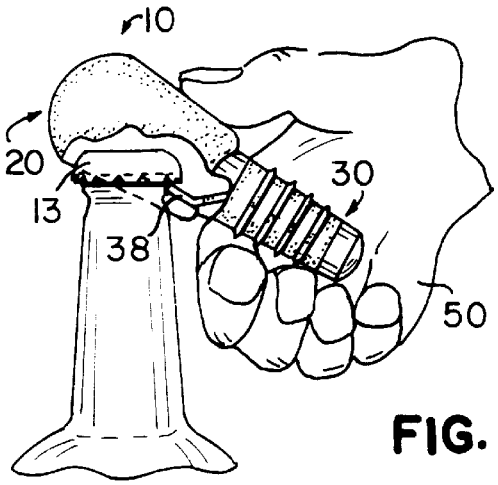
FIG. 8 is a side elevational view with portions removed, illustrating the use of the invention as a pop-top cap remover.
Figure 9:
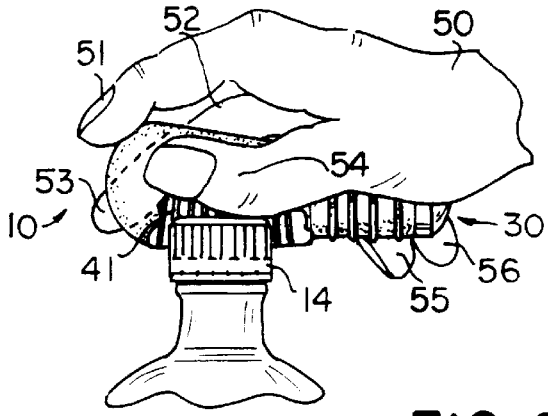
FIG. 9 is a view similar to FIG. 8, illustrating use of the utensil of the invention as a twist-off cap remover.

Referring to FIGS. 1–6, there is illustrated a combination utensil, generally designated by the numeral 10, in accordance with the present invention. Referring to FIGS. 7–9, the utensil 10 is designed to serve as a stopper for use with a bottle, such as a bottle 11 which may, for example, be a wine bottle. More specifically, the utensil 10 can serve as a stopper to close the neck 12 of the bottle 11 once the bottle cork or other closure member has been removed, as illustrated in FIG. 7. The utensil 10 can also be used for removing pop-top caps 13 (FIG. 8) or twist-off caps 14 (FIG. 9) of associated bottles, as will be explained more fully below.

Figure 1:
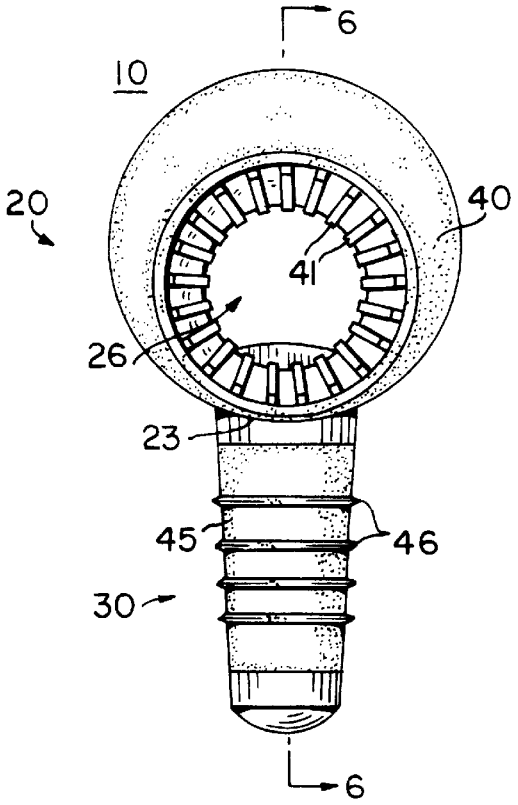
FIG. 1 is a front elevational view of a combination utensil in accordance with the present invention.
Figure 2:
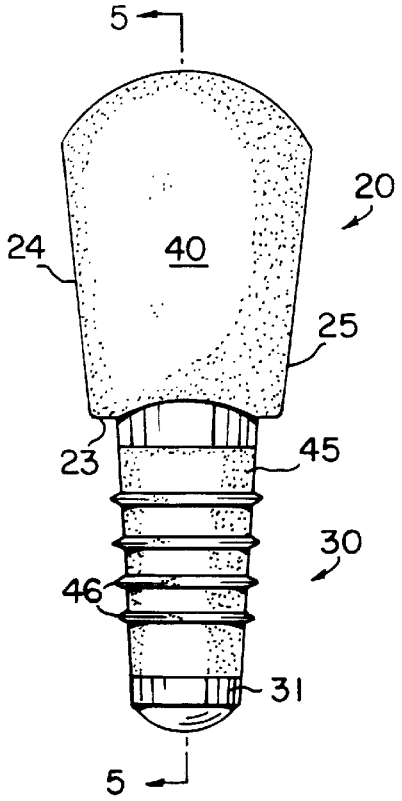
FIG. 2 is a side elevational view of the utensil of FIG. 1.
Figure 3:
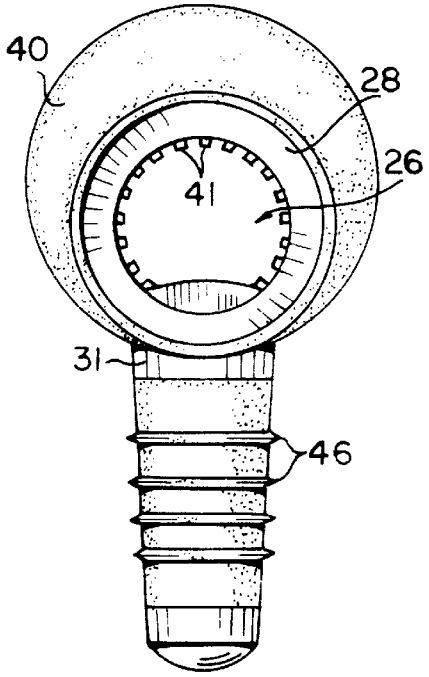
FIG. 3 is a rear elevational view of the utensil of FIG. 1.
Figure 4:
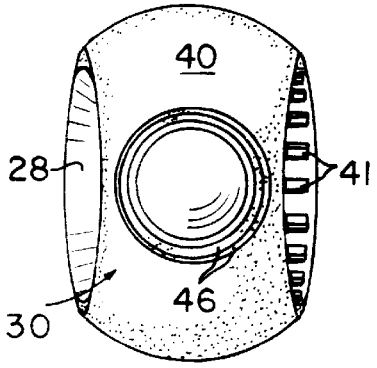
FIG. 4 is a bottom plan view of the utensil of FIG. 3.
Figure 5:
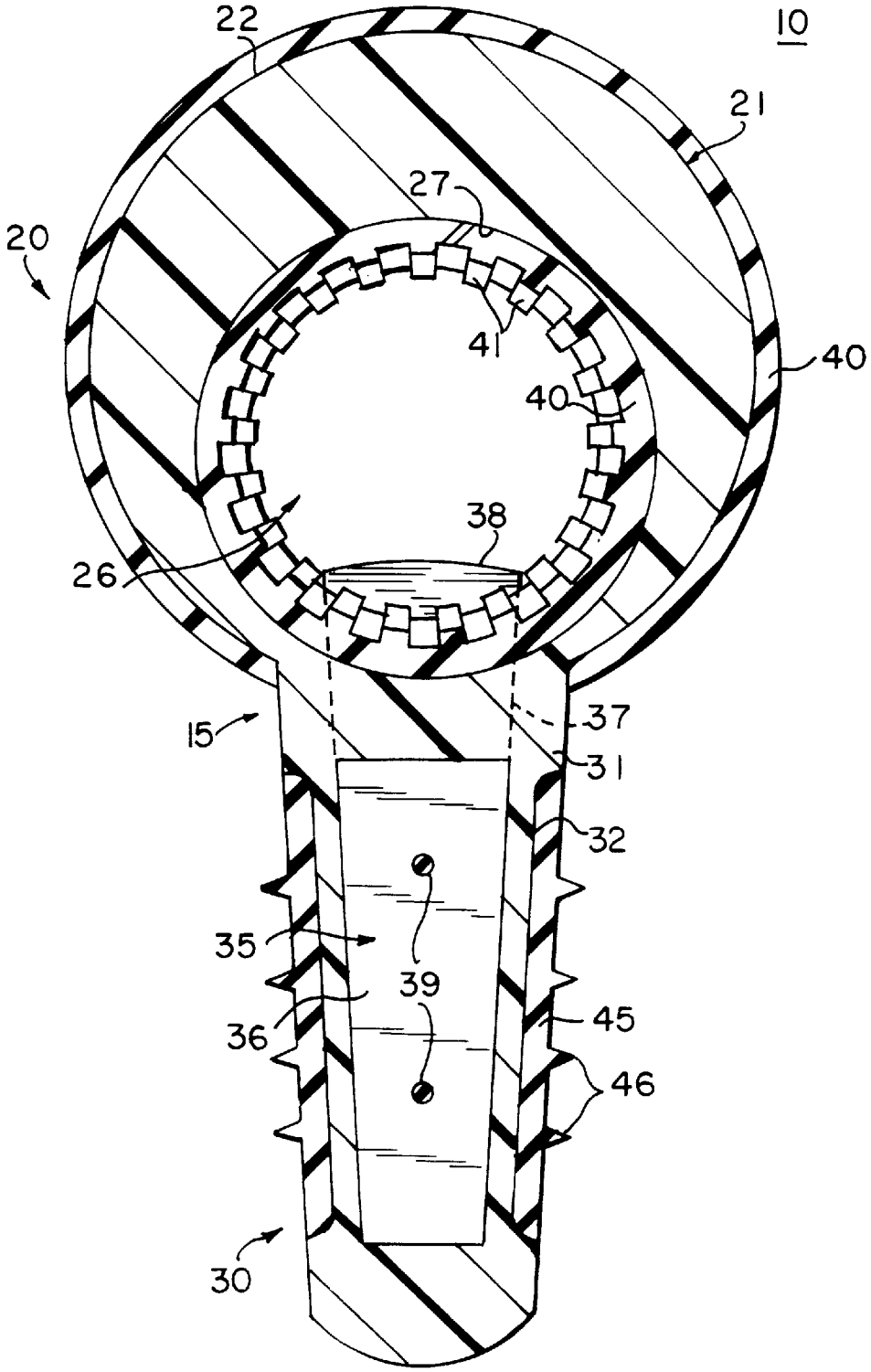
FIG. 5 is an enlarged view in vertical section taken generally along the line 5—5 in FIG. 2.
Figure 6:
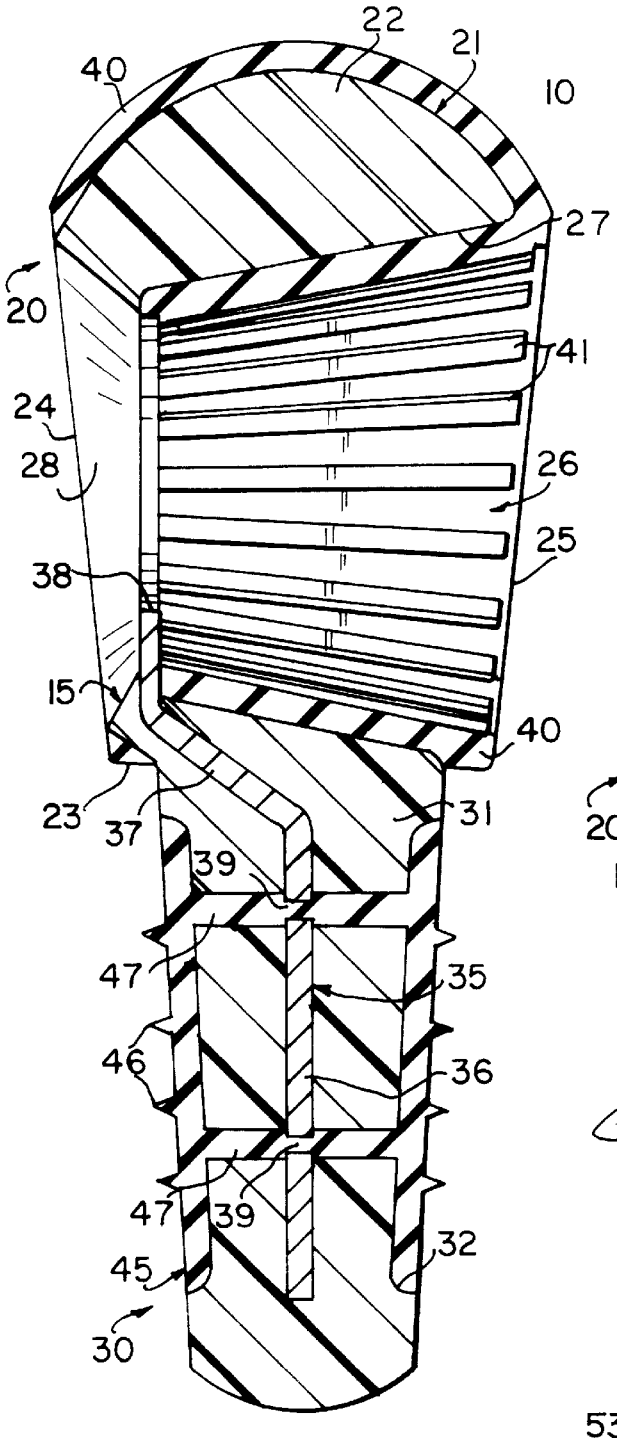
FIG. 6 is an enlarged view in vertical section taken generally along the line 6—6 in FIG. 1.

Referring to FIGS. 5 and 6, the utensil 10 includes a unitary, one-piece body 15, which is a rigid member preferably formed of a suitable plastic material, such as polypropylene. The body 15 has a ring portion 20 with an outer surface 21 which includes a convex, curved upper portion 22 and a substantially flattened bottom portion 23. The ring portion 20 is relatively thick and is provided with tapered or inclined end faces 24 and 25 which converge toward the flattened bottom portion 23. The ring portion 20 has an opening 26 formed therethrough and defined by a frustoconical inner surface 27, the ring portion 20 having a chamfered surface 28 at the small-diameter end of the opening 26. Preferably, the opening 26 is disposed eccentrically relative to the ring portion 20, being offset toward the flattened bottom portion 23.

The body 15 also includes an elongated stopper portion 30 projecting substantially radially from the ring portion 20 at the flattened portion 23. The stopper portion 30 has a tapered body 31 generally frustoconical in shape and tapering toward a reduced-diameter distal end. The tapered body 31 has an annular recess 32 formed in the outer surface thereof intermediate the ends thereof and extending along the majority of the length of the tapered body 31.

Embedded in the stopper portion 30, as by insert molding, is an elongated insert plate 35, preferably formed of a suitable metal, such as stainless steel. The insert plate 35 has an elongated main body 36 disposed centrally of the tapered body 31 of the stopper portion 30 and having a width which is tapered to match the taper of the body 31. The main body 36 of the insert plate 35 is joined at its upper end by an offset shoulder 37 to an upstanding lip 38, which projects into the opening 26 at the inner edge of the chamfered surface 28, the end edge of the lip 38 preferably forming a very large-radius arc.

Referring also to FIGS. 1–4, the ring portion 20 is substantially covered with a ring sheath 40, formed of a frictional and cushioning material, such as an elastomeric material of type sold under the trade name SANTOPRENE. The sheath 40 covers the entire outer surface 21 and frustoconical surface 27 of the ring portion 20, except for the chamfered surface 28. The portion of the sheath 40 covering the frustoconical inner surface 27 defines a plurality of circumferentially spaced and radially inwardly projecting ribs 41, each extending substantially the axial length of the frustoconical inner surface 27.

The stopper portion 30 is also provided with a stopper sheath 45 disposed in the annular recess 32, and preferably formed of the same material as the ring sheath 40. The stopper sheath 45 includes a plurality of axially spaced and radially outwardly projecting annular flanges 46.

The utensil 10 may be formed by a suitable molding technique. Preferably, the insert plate 35 is insert molded in the body 15 and the sheaths 40 and 45 are then molded around the body 15. The main body 36 of the insert 35 has small openings or holes 39 therethrough to facilitate the mounting of fixtures to hold the plate in place in a mold. After the molding of the body 15, these fixtures are removed and, during the molding of the stopper sheath 45, the diametral holes through the stopper portion tapered body 31 left by removal of the plate-supporting fixtures are filled with the sheath material, forming diametral fingers 47.

It is a significant aspect of the invention that the utensil 10 is ergonomically shaped and dimensioned to fit comfortably in a user's hand for ease of use. Thus, the ring portion 20 is a relatively large and rounded member designed to fit comfortably in the palm of the user's hand. In a constructional model of the invention, the ring portion 20, including the ring sheath 40, has an overall width of about 51 mm, a thickness between the upper ends of the inclined faces 24 and 25 of about 36 mm, and a height of about 51 mm, the stopper portion 30 having a length of about 46 mm. Each of the end faces 24 and 25 (see FIG. 2) is inclined at an angle of about 6 degrees to the central plane along which the section of FIG. 5 is taken.

In use, referring to FIG. 7, the tapered and ribbed construction of the stopper portion 30 permits it to snugly close various sizes of bottle necks 12, in a known manner. The large, rounded ring portion 20 serves as a handle during this operation.

Referring to FIG. 8, the small-diameter end of the ring portion opening 26 is dimensioned so that, in use, it can receive therein a portion of a pop-top bottle cap 13, with the lip 38 of the insert plate 35 fitted beneath the flange of the cap so as to permit the cap to be pried off. In this regard, the unsheathed chamfered surface 28 provides a lead-in surface to the opening 26 to guide the bottle cap and provides a hard, unsheathed surface to facilitate prying of the bottle cap off the bottle neck. Referring to FIG. 8, this manner of operation of the utensil 10 is illustrated, and it can be seen that the stopper portion 30 serves as a handle which fits comfortably in a user's hands, with fingers of the hand wrapped therearound and the user's thumb seated on top of the ring portion 20.

In removing a twist-off cap 14, the large-diameter end of the opening 26 is fitted over the cap, as illustrated in FIG. 9, the stopper portion 30 again serving as a handle for the utensil 10. The ribs 41 of the ring sheath 40 provide a wedging, frictional gripping of the associated cap 14 to prevent slippage of the utensil 10 relative thereto. The utensil 10 is then rotated, as indicated by the arrow in FIG. 9, to twist off the cap.

While FIG. 9 illustrates the use of the utensil 10 with a cap of the tamper-proof type, it will be appreciated that could be used with twist-off caps of the general size and shape of the cap 13, illustrated in FIG. 8, such as those used on many beer bottles. In this regard, the ribs 41 may be equal in number to the flutes of the bottle cap edge for engagement in the flutes to improve performance, but this is not necessary.

It will be appreciated that the sheaths 40 and 45 serve to provide a good frictional grip of the associated twist-off bottle cap and good sealing engagement with a bottle neck, as well as providing a non-slip frictional grip and a comfortable cushioned feel for the user's hand. The ergonomic design of the utensil 10 affords ease and comfort of use for the user and improved leverage, so that the utensil can be comfortably operated even by persons with impaired hand functioning, such as those suffering from arthritis or the like.

While preferred materials, dimensions and methods of manufacture have been described above, it will be appreciated that other materials and fabrication techniques and other dimensional relationships could also be provided without departing from the principles of the present invention. A significant aspect of the invention is that it provides a tool of integral construction which affords both bottle cap-removing and bottle stopping portions which, respectively, serve as handles for each other, the bottle cap-removing portion being usable with both pop-top and twist-off caps.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A combination bottle cap-removing and bottle neck-closing utensil comprising:

a bottle-cap-engaging ring dimensioned to fit in a user's hand and having a substantially frustoconical opening therethrough dimensioned to receive at least a portion of a bottle cap therein, and a stopper unitary with and extending laterally outwardly from said ring and dimensioned to fit in a user's hand and to be received in a bottle neck for closing same, whereby the ring and the stopper serve as handles for each other.

2. The utensil of claim 1, wherein said stopper tapers from a wide end adjacent to the ring to a narrow end remote from the ring.

3. The utensil of claim 2, wherein said stopper includes a plurality of longitudinally spaced circumferential flanges projecting radially outwardly from said stopper.

4. The utensil of claim 1, wherein said ring includes radially inwardly projecting ribs spaced around the periphery of said opening.

5. The utensil of claim 1, wherein said opening is non-coaxial with said ring.

6. The utensil of claim 1, wherein said stopper projects substantially radially from said ring.

7. The utensil of claim 1, wherein said opening has a central axis, said ring having end faces respectively inclined with respect to a central plane perpendicular to said axis, said end faces converging toward said stopper.

8. A combination bottle cap-removing and bottle neck-closing utensil comprising:

a bottle-cap-engaging ring dimensioned to fit in a user's hand and having an opening therethrough dimensioned to receive at least a portion of a bottle cap therein, a stopper unitary with and extending laterally outwardly from said ring and dimensioned to fit in a user's hand and to be received in a bottle neck for closing same, a first sheath of cushioning friction material substantially covering exposed surfaces of said ring, and a second sheath of cushioning frictional material covering said stopper along most of the length thereof, whereby the ring and the stopper serve as handles for each other.

9. A bottle cap remover comprising:

a ring-like body having an internal generally frustoconical wall defining an opening through the body and having large-diameter and small-diameter ends, a rigid lip carried by said body and projecting into said opening adjacent to the small-diameter end, and a sheath of cushioning frictional material substantially covering said body including said internal wall.

10. The bottle cap remover of claim 9, and further comprising a plurality of radially inwardly projecting ribs spaced circumferentially around said opening and each extending substantially from said large-diameter end to said small-diameter end.

11. The bottle cap remover of claim 9, wherein said sheath includes a plurality of radially inwardly projecting ribs spaced circumferentially around said opening and each extending substantially from said large-diameter end to said small-diameter end.

12. The bottle cap remover of claim 9, wherein said body has an uncovered chamfered surface encircling the small-diameter end.

13. The bottle cap remover of claim 9, wherein said body is formed of a rigid plastic material.

14. The bottle cap remover of claim 13, wherein said lip is formed of metal.

15. A combination bottle cap-removing and bottle neck-closing utensil comprising:

a unitary one-piece body having a ring-like portion and a stopper portion, said ring-like portion being dimensioned to fit in a user's hand and having an internal generally frustoconical wall defining an opening through the ring-like portion and having large-diameter and small-diameter ends, and a rigid lip carried by said body and projecting into said opening adjacent to the small-diameter end, said stopper portion extending laterally outwardly from said ring-like portion and dimensioned to fit in a user's hand and to be received in a bottle neck for closing same, whereby the ring-like portion and the stopper portion serve as handles for each other.

16. The utensil of claim 15, and further comprising a metal insert plate embedded in and extending longitudinally of said stopper portion and having a flange portion forming said lip.

17. The utensil of claim 16, wherein said insert plate includes a main body portion extending centrally of said stopper portion, and an offset shoulder portion adjacent to said ring joining said flange portion to said main body portion.

18. The utensil of claim 15, wherein said body includes a chamfered surface encircling the small-diameter end of said opening.

19. The utensil of claim 18, and further comprising a plurality of radially inwardly projecting ribs spaced circumferentially around said opening and each extending substantially from said large-diameter end to said chamfered surface.

20. The utensil of claim 15, wherein said opening is disposed eccentrically of said ring, said opening has a central axis, said ring-like portion has end faces respectively inclined with respect to a central plane perpendicular to said axis, and said end faces converge toward said stopper portion.

* * * * *

UNITED STATES PATENT AND TRADEMARK OFFICE

CERTIFICATE OF CORRECTION

PATENT NO. : 6,179,138 B1
DATED : January 30, 2001
INVENTOR(S) : Cyan Puleston

It is certified that error appears in the above-identified patent and that said Letters Patent is hereby corrected as shown below:

Title page,
Add to Item [56], References Cited, U.S. PATENT DOCUMENTS:

| | | |
|---|---|---|
| -- D. 184,726 | 3/1959 | Gill |
| D. 249,452 | 9/1978 | Gendron |
| D. 296,524 | 7/1988 | Schneider |
| 729,835 | 6/1903 | Barnes et al. |
| 760,097 | 5/1904 | Biersach |
| 959,220 | 5/1910 | Hoeft |
| 2,631,482 | 3/1953 | Rinehart |
| 4,001,904 | 1/1977 | Gill |
| 4,455,894 | 6/1984 | Roberts |
| 4,702,129 | 10/1987 | Allen |
| 4,911,038 | 3/1990 | Ferrin --. |

Signed and Sealed this

Twenty-fifth Day of December, 2001

*Attest:*

*Attesting Officer*

JAMES E. ROGAN
*Director of the United States Patent and Trademark Office*